US005759138A

United States Patent [19]

Boland

[11] Patent Number: 5,759,138

[45] Date of Patent: Jun. 2, 1998

[54] ABDOMINAL AND ARMS MUSCLES EXERCISE DEVICE

[76] Inventor: Kevin O'Brien Boland, 5623 Massachusetts Ave., Bethesda, Md. 20816

[21] Appl. No.: 821,542

[22] Filed: Mar. 21, 1997

[51] Int. Cl.[6] ..... A63B 21/02

[52] U.S. Cl. ..... 482/122; 482/125; 482/140

[58] Field of Search ..... 482/121, 122, 482/124, 125, 126, 140

[56] References Cited

U.S. PATENT DOCUMENTS

| | | | |
|---|---|---|---|
| 4,591,150 | 5/1986 | Mosher | 482/125 |
| 4,726,580 | 2/1988 | Batiste et al. | 482/122 |
| 4,900,015 | 2/1990 | Dissinger | 482/121 |
| 5,176,601 | 1/1993 | Reynolds | 482/121 |
| 5,224,914 | 7/1993 | Friedman | 482/140 |
| 5,232,425 | 8/1993 | Miller et al. | 482/121 |
| 5,637,066 | 6/1997 | Chang | 482/121 |
| 5,669,862 | 9/1997 | Hayman | 482/140 |
| 5,669,863 | 9/1997 | Ho | 482/125 |

*Primary Examiner*—Lynne A. Reichard
*Attorney, Agent, or Firm*—Arthur R. Eglington

[57] ABSTRACT

A portable abdominal and arm exercise device includes a first pair of elongate parallel rigid members forming a base with an elongate trough therein for receiving one end of a rigid spanning bar, a second pair of upstanding spaced-apart rigid members attached at their lower ends to the first pair of elongate parallel rigid members and attached at their upper ends to one end of a cross bar. The cross-bar is attached at its other end to the rigid spanning bar.

5 Claims, 8 Drawing Sheets

ABDOMINAL AND ARMS MUSCLES EXERCISE DEVICE

FIELD OF THE INVENTION

The present invention relates to a portable exercise device adapted for selective human muscle conditioning and development.

BACKGROUND OF THE INVENTION

The need for practical and efficient devices suited for muscular toning and human body conditioning is a long established one. There are a variety of exercise devices, including powered machines, that selectively challenge different sets of body muscles. One area of sought exercise is directed to the abdominal, biceps, and triceps muscle sets. One such device described in the patent literature as is described in U.S. Pat. No. 5,232,425 (granted Aug. 3, 1993 to J. V. Miller et al). The Miller patent teaches a device that involves direct, progressive resistance to the user over the field of action. This means that during movement over the inherent range of motion for the prior art device, that its resistance level increases linearly, as opposed to a preferred constant plus consistent resistance level throughout the device range of motion.

The prior art device lacks the mechanical features and architecture that can provide biceps toning in the course of using a curling motion. This feature is made more evident by resort to FIGS. 11–17, of Miller on its one preferred embodiment. FIGS. 11 and 12 show the extreme postures effected in using the device upright and crouched. Looking to Miller's FIGS. 13, 15, and 16, an elastic band 124 is rigged over spaced-apart, opposing hook ends 120/134, so that user exertion on cross bands 40/41 results in a linearly increasing resistance as the finite length band 134 is extended. Miller also lacks a structural element positioned perpendicular to the user's body, thereby precluding a curling exercise.

It is a principal object of the present invention to provide a portable abdominal and arms exercise device that can be used alternately for abdominal toning, biceps muscle toning, forearm muscle toning, and triceps muscle toning by simple realignment of its operating position.

It is another object of the invention to provide an exercise device which incorporates a preferred constant resistance level feature occurring throughout the defined range of motion for the device user.

It is still another object of the invention to provide a device employing a linkage-based system versus a direct resistance system yielding a lineal and consistent resistance throughout its range of motion.

A yet further object of the invention is to provide a portable unit that folds up for easy shipment and/or storage.

It is a still further object of the invention to provide a device which precludes the need for positioning of the hands adjacent the user's chest (as seen with Miller '425 FIGS. 11 and 12), rather by steadying the device just within the user thighs, thus making for a concise and focused abdominal exercise.

SUMMARY OF THE INVENTION

According to the present invention, there is provided an exercise device adapted to alternately condition four different sets of muscles by relying on a rolling lever type of mechanism coupled with a linkage-based, counter resistance means, which configuration allows for a consistent and smoother range of motion for the exerciser. The new device includes an elongate first pair of parallel rigid members, serving as a lap-based component, which first pair also define a sheltered, elongate trough that receives pivotally therein, one longitudinal end (lower) of a rigid spanning bar and associated tensioning means; the other longitudinal end (upper) of the spanning bar is pivotally pinned to a shorter cross-bar, which cross bar is itself mounted straddling an upstanding second pair of spaced-apart, but conveniently converging, rigid members; with the upstanding second pair of members being anchored at their lower longitudinal ends to the lap-engaging, longitudinal ends of the elongate first pair of members.

The pair of converging upstanding members, optionally arcuately bowed in this middle segment, are conjoined at their upper longitudinal ends, and are pinned to a transverse, rigid cross-bar, which horizontally-aligned bar is positioned against the user's chest, during either of the crunching or curling exercises (FIGS. 1 and 2). At the outer (distal) longitudinal end of the lap-based first pair of members, there is centered a third elongate, rigid cross bar, which cross bar further includes a set of manually grippable means for activation of the exercise device, while the same device is supported in the seated user's lap, and resting against his chest. This gripping means cooperates with the opposing end of the first pair on the transverse bar, which is tucked across the horizontal body line defined by the joining of the lap and abdomen. The grippable means themselves comprise upwardly-oriented, opposing terminal segments of the distal perpendicularly-aligned bar.

As noted, the single spanning bar terminates within the trough of the first pair of parallel members and is at its lower end adapted to affect reciprocal linear movement therein, responding to user's exertion made on the gripping bars in a closing direction. The spanning bar lower end is concurrently tied to a horizontally-aligned, tensioning band, which provides the counterforce (resistance level) to the user's force being exerted on the grippable means over the device range of motion. An alternative means for the counterforce would be a hydraulic cylinder on a spring-based device.

The upper cross member is preferably provided with a pair of sleeve-type cushion elements that serve to ease the compression on the user's chest, occurring while he is exerting either crunching or curling effort on the gripping handles.

The lap-based (centered) first pair of parallel members are each further provided with a linear channel disposed lengthwise of its inner surface with the resulting opposing channels thus presenting a running track for a rolling-mounted short crossbar, which is pinned to the lower end of the spanning bar, so as to engage same in a sliding manner. This form of flexible linkage for the spanning member permits it to move reciprocally within the device trough, in response to the countervailing forces, being first exerted on such spanning member by the operatively attached elastic band and concurrently, but intermittently, by the upstanding second pair of converging members, as the linked crossbar that is chest-side is swung arcuately toward the trip handle cross member on the outer end by an exerciser, thus moving the spanning bar counter to the elastic band tension.

Generally, abdominal and biceps muscle sets strengthening are afforded by the user's gripping of the handle ends of the distal cross-member, and then chest pushing the upper cross member (resistance bar) in a downward arc range of motion toward the user's closed lap sides (see FIG. 1). Similarly so, with the curling exercise, except that the distal grip handles are drawn upwardly towards the chest (see FIG.

2). In curls, palms are up for biceps extension, and palms down for forearm extension. While the abdominal and biceps workups have a reciprocal range of motion, for the triceps exercise, the device itself is first rotated 90° forwardly to the operating mode seen in FIG. 3. After securing it firmly against the user's thighs (to eliminate any lap sliding), with hand palms up, the grip handles are pulled inwardly towards the user's lap, to perform the triceps exercise. Thusly, this single device is adapted to serve to provide toning for the abdominal, biceps, and triceps muscle sets.

DETAILED DESCRIPTION OF PREFERRED EMBODIMENT

Figure 1:
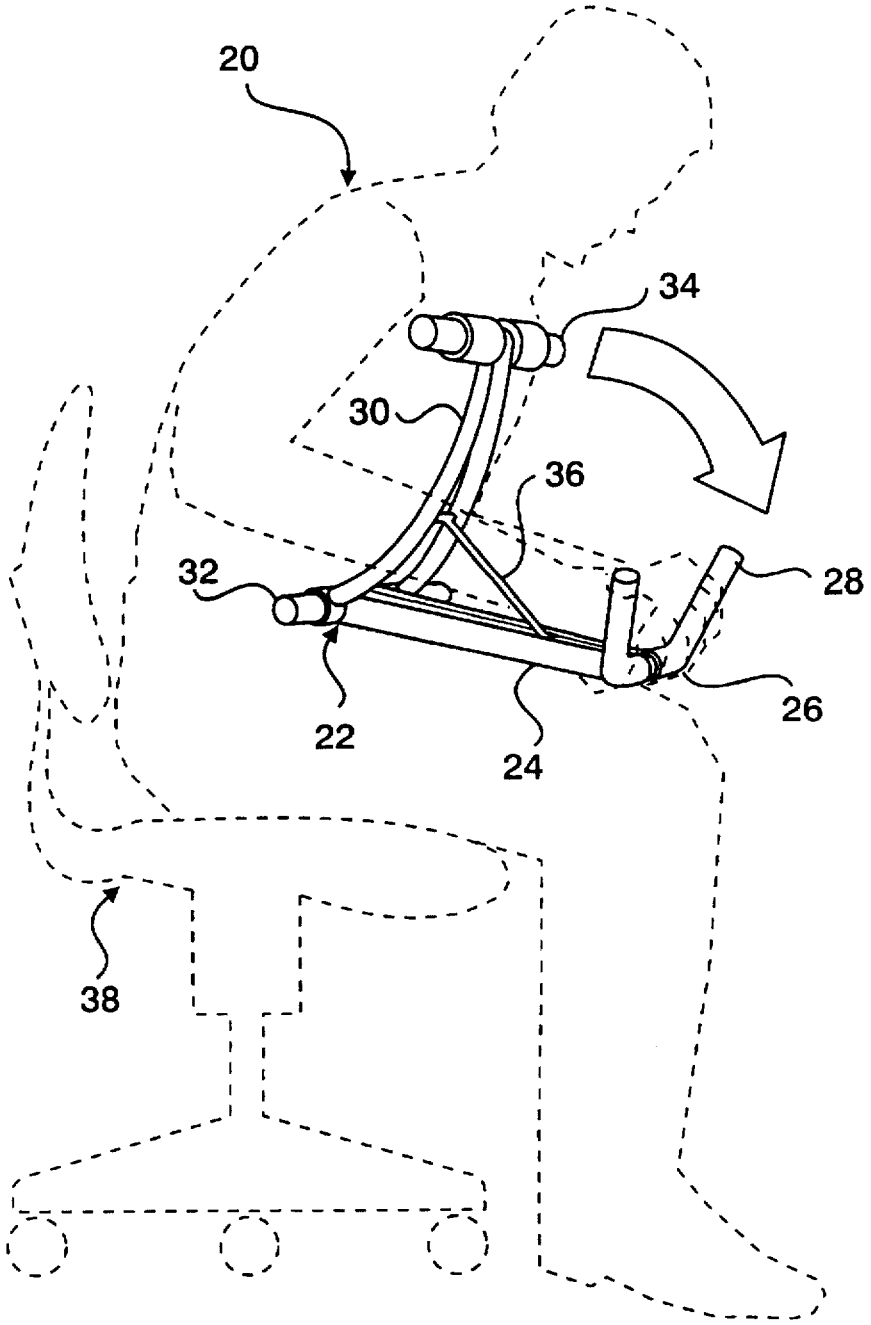
FIG. 1 is a schematic perspective view of a male exerciser (in phantom) employing the inventive device in a crunching (abdominals) exercise.

While the present invention is susceptible to some modifications so to effect the pretensioning aspect of the preferred embodiment, which is depicted in the drawing, it will be described in detail. It should be understood, that there is no intention to limit the depicted invention to the particular structure which is described here in detail, but it is intended to embrace modified constructions and functional equivalents falling within the scope of the appended claims.

Referring now to the drawing, as shown in each of the schematics of FIGS. 1–4, it is an ABS and Arms exercise device. In each view, the device is engaged by an exerciser. It includes: the portable lap-positioned device, generally 22, having a lap-supported, elongate, linear pair of sidewall members 24L/R; a distal, elongate cross-member 26 with terminal upswept handles 28; a lower elongate crossbar 32 (tucked into the exerciser's lap); an upstanding pair of support members 30; an upper elongate crossbar 34 for members 30, resting against the upper torso; and an inclined single spanner-bar 36, which is functionally linked between the upstanding pair 30 of members and a device tensioning mechanism (not seen), conveniently located in the trough of members 24L/R. The user is necessarily seated on a chair 38 while exercising. Note that in FIG. 1, the user's hands should be oriented appropriately to maintain the lap position for the device 22 during exertion.

In FIG. 1, the user is engaged in a leaning, forward motion, while his upper torso pressures crossbar 34 concurrently with bracing of the manually-gripped handle bar 28, thus retaining the device static while supported in the lap of the user. The arcuate/reciprocal range of motion stresses and conditions primarily the abdominal muscles during the "crunching" effort, and its complemental return to upright (which is effected through several repetitions).

Figure 2:
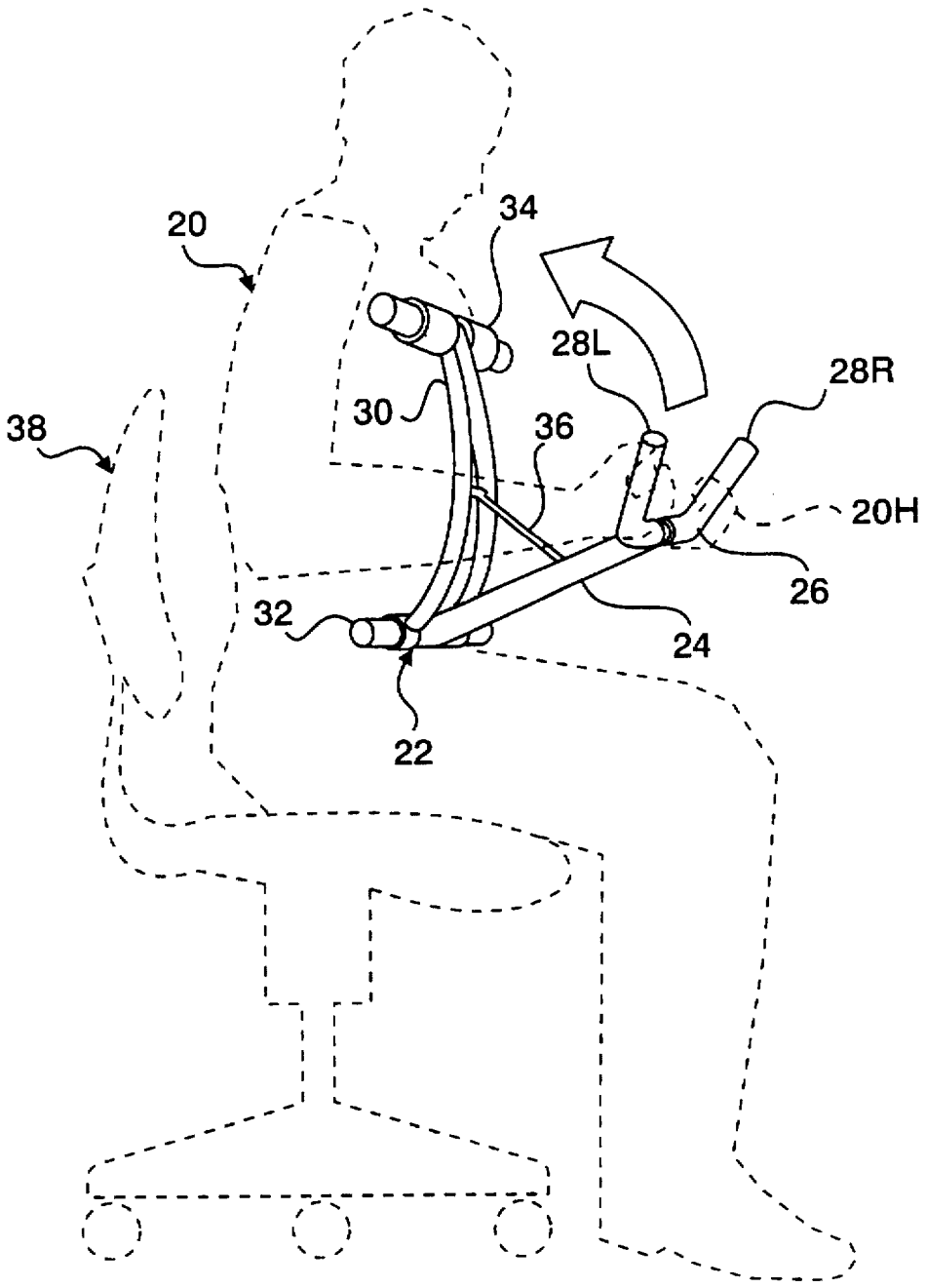
FIG. 2 is another perspective view of a male exerciser employing the similarly aligned inventive device but in a curling (biceps) conditioning exercise.

In the schematic view of FIG. 2, the user is in a seated, upright position with his upper torso and lap both serving as a bracing posture for device 22, but now while a curling motion is carried out. The biceps conditioning effort is effected by manually drawing the handles 28 toward the upper torso against the resistance provided by upwardly shifting spanner-bar 36. Upon release of the manual effort, the device returns to the at-rest gap between handles 28 and upper crossbar 34, until the next repetition.

Figure 3:
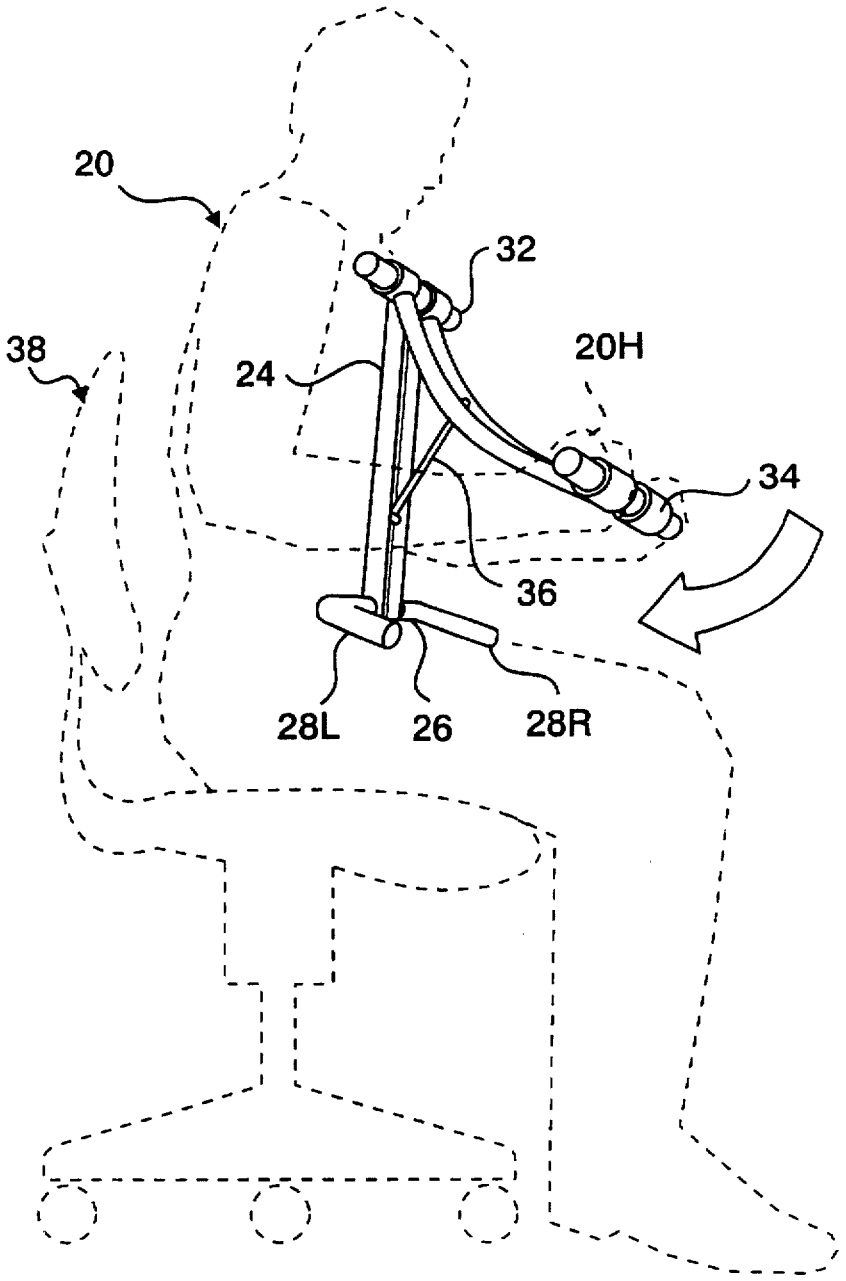
FIG. 3 is another schematic perspective view of a male exerciser employing the now realigned inventive device in a triceps conditioning exercise.

In the schematic view of FIG. 3, the device 30 has been realigned to permit a triceps conditioning exercise. It is rotated 90° forwardly (clockwise) so that the upright handles 28 straddle the user's lap and the upper crossbar 34 then becomes the manually grippable, muscle exertion bar. The device is further steadied by the other crossbar 32, now resting against the upper torso. The inward-downward effort made by the underlapped hands (palms up?) 20H is to draw crossbar 32 towards the user's lap, relying primarily on his triceps (see arrow), which are exerted against the resistance of spanning bar 36. Upon relaxation, the crossbar 34 returns to the at-rest gap, shown between handles 28 and crossbar 34, until the next repetition.

In all of the described exercises, the manual effort upon a cross member in the defined arcuate range of motion causes spanning bar 36 to move along a track-follower assembly (to be described) against the countervailing tension imposed thereon by an operatively-connected tensioning band (also to be described). In all three, upon manual release, the follower assembly returns to its at-rest position as defined by the unstretched length of an associated tensioning band, or its equivalent resilient tensioning structure.

Figure 4:
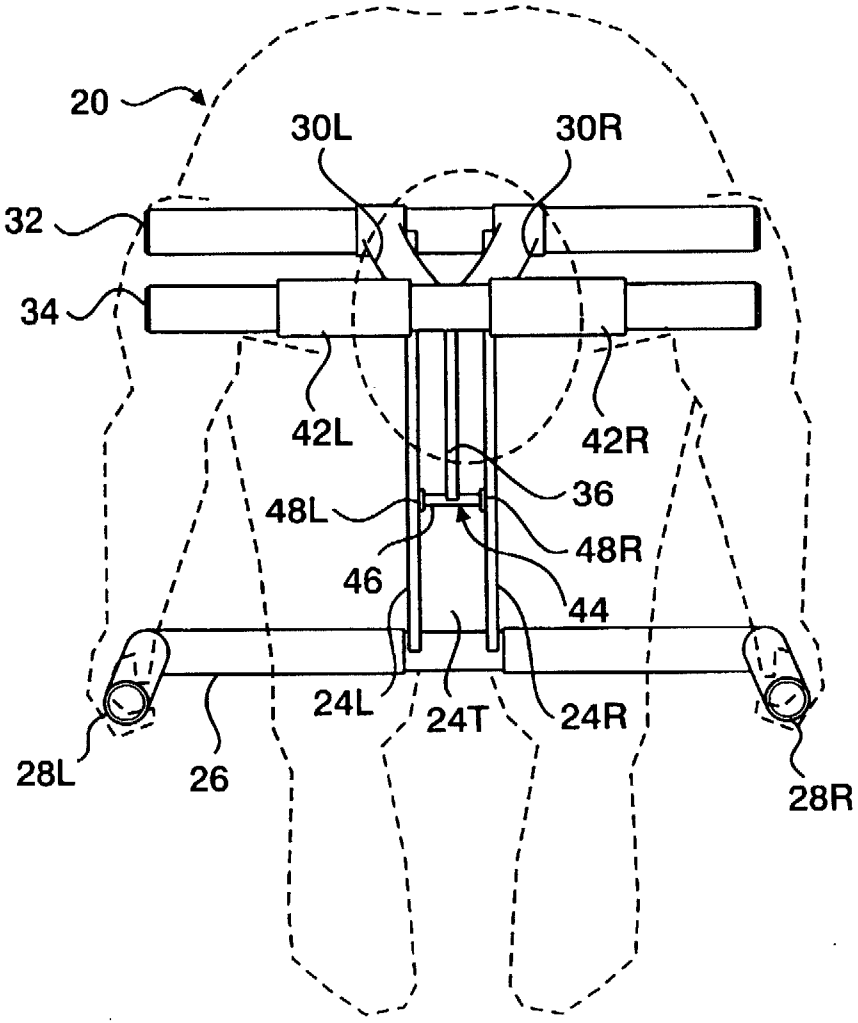
FIG. 4 is a top plan view of the inventive device as aligned in the exercises of FIG. 2.

The top plan schematic view of FIG. 4 depicts the user engaged with the device while in the curling exercise of FIG. 2 (palms facing inward?) about the handles 28. The paired upstanding members 30L/30R are seen as upwardly converging to be secured at their union to crossbar 34, which bar is further provided with cushioning sleeves 42L/R for minimizing pressure discomfort on the upper torso. Central spanner bar 36 is seen with its lower longitudinal end attached to a track-follower assembly 44, which assembly is composed of a short crossbar 46 and its operatively attached, outer-end rollers 48L/R. As is apparent, assembly 44 moves reciprocally within a longitudinal trough 24T of member 24 (not seen) responding to the movement of spanner bar 36; which bar, in turn, responds to partial closing of the space between distal handles 28L/R and cushioned upper cross member 34. Lower cross member 32 is tucked into the crease between the user's lap and his torso for device stability and action.

Figure 5:
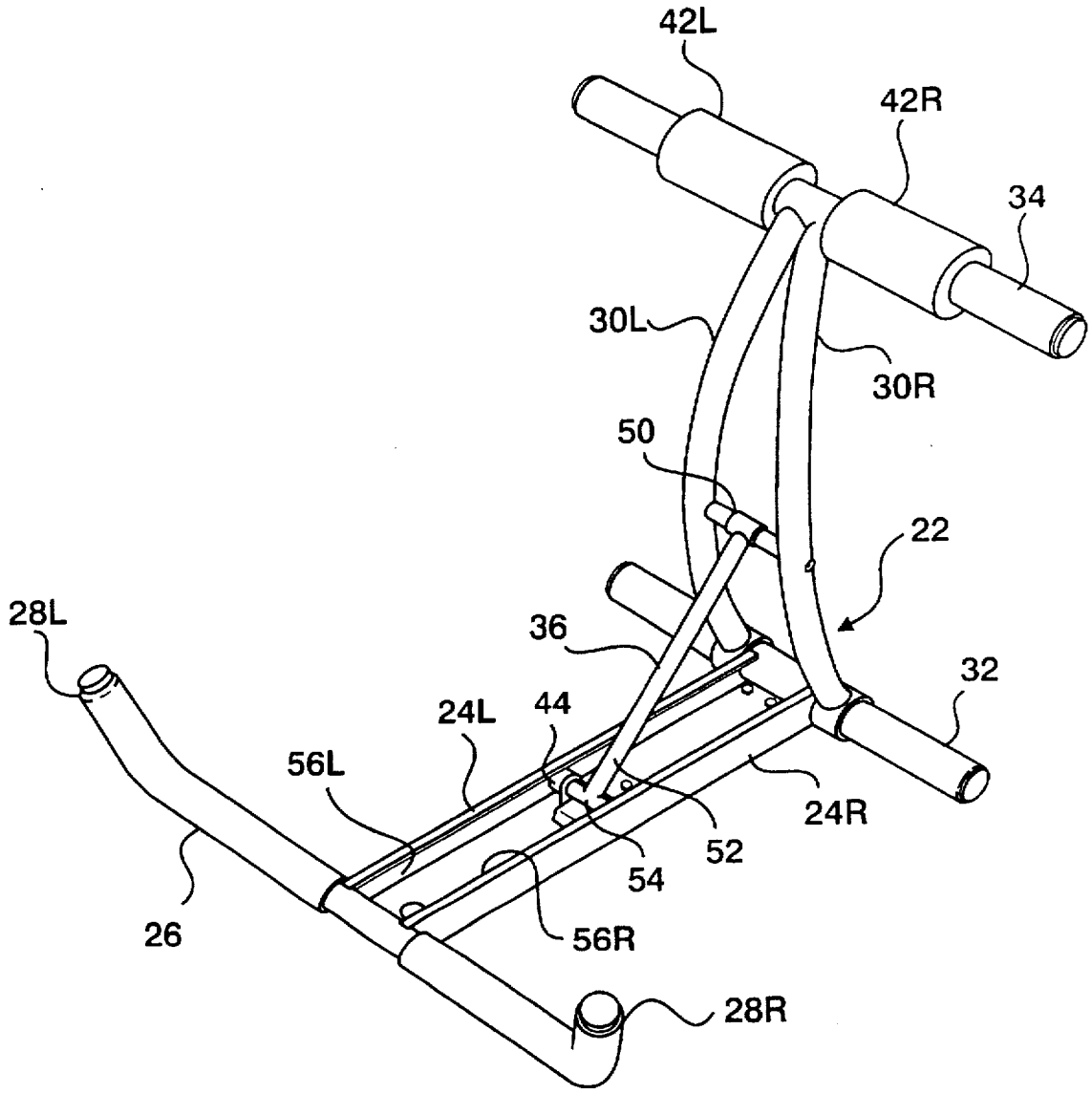
FIG. 5 is a perspective view of the inventive device of FIGS. 1 to 3, now seen from the side normally distal from the exerciser's chest, but standing alone.

The perspective view of FIG. 5 shows the exercise device 22, standing alone, as it would be spatially-oriented to conduct either of the crunching or curling exercises shown in FIGS. 1 and 2 (and 4). A short cross member 50 straddles and interconnects between converging upright members 30L/R intermediate of their upper and lower longitudinal ends. Member 50 is centrally attached to the upper end of spanner bar 36 and is adapted to pivot with it as the latter tracks trough 24T; while the lower longitudinal end 52 of spanner bar 36 is likewise adapted to pivot at its lower longitudinal end. Spanning bar end 52 is linked to hollow cross member 54, which is positioned transversely of the spaced-apart parallel sidewalls 24L/R. The opposing inner surfaces of paired sidewalls 24L/R are each provided with a linear channel 56L/56R, which channels are slidingly engaged by the outer-end rollers 48L/R of follower assembly 44. Assembly 44 is preferably configured as a bracket-type platform, with laterally aligned upstanding lugs, that accommodate the axle (not seen) of roller set 48L/R within member 54. Disposed longitudinally in the proximal segment of trough 24T is a horizontally-aligned resilient tensioning band 58.

Band 58 is secured (detachable) at its proximal (torso-side) end to the center segment of proximal cross member 32, and it is secured at its distal longitudinal end (detachably) to the proximal side of assembly 44. In the unextended position, band 58 is sized to define the preferred intermediate position for follower assembly 44, when not tracking within the dual sidewall channels 56L/R of elongate U-shaped member 24. As the handles 28 are drawn toward upper cross bar 34, this causes spanning bar 36 to move its lower end 52 outwardly, moving associated follower assembly 44 towards distal cross bar 26, but concurrently doing so against the limiting counter-tension imposed by stretching of resilient band 26. Clearly, as either the crunching or curling exertions on the cross member are relaxed, the spanning bar 36 draws the follower assembly 44 back to its at-rest position, as is depicted.

Figure 6:
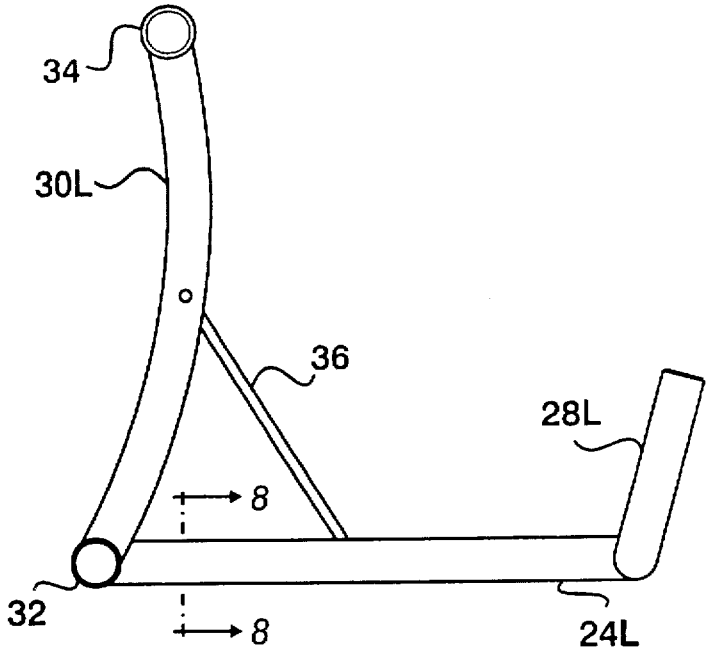
FIG. 6 is a side elevational view of the inventive device, standing alone.
Figure 7:
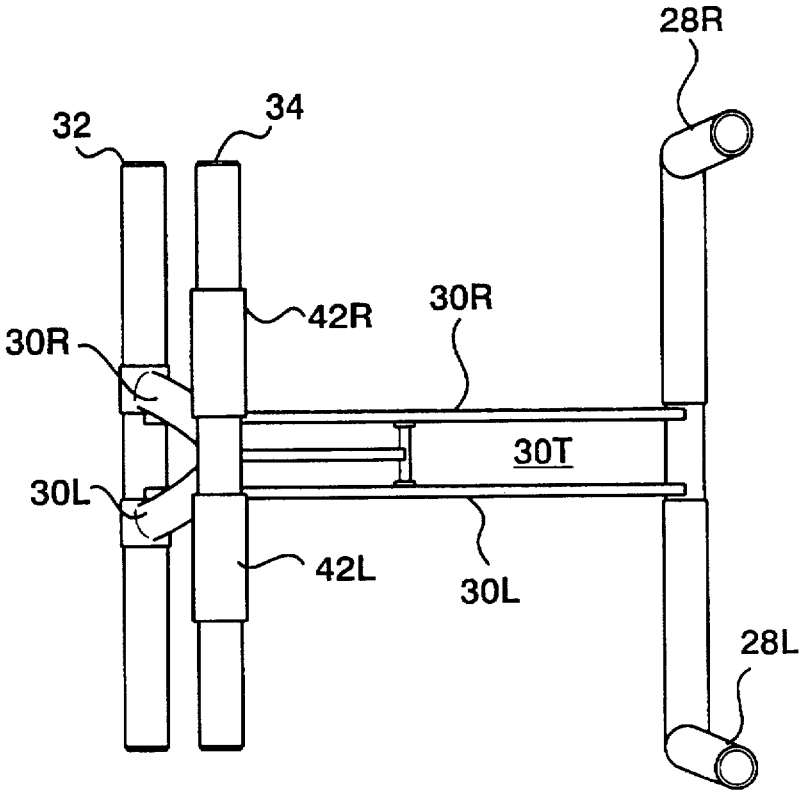
FIG. 7 is a top plan view of the inventive device, as seen in FIG. 5 standing alone.

In FIGS. 6 and 7, are shown side elevation and top elevation views, respectively, of the inventive device, standing alone, but further depicting the operative, central reciprocating linkage, that provides the uniform resistance needed for the effective use of the device in varied muscle set conditioning.

Figure 8:
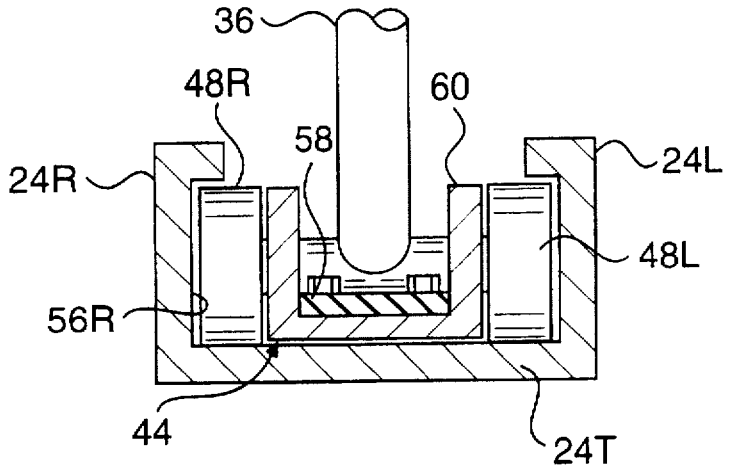
FIG. 8 is a vertical sectional view taken along lines 8—8 in FIG. 6 of the components of the elastic bands, preferably mounted within the trough of the lap-based member, which resilient means functions to provide the counterforce (resistance level) to the force exerted by the movement of the gripping bars of the device.

The vertical sectional view of FIG. 8, taken behind the follower mechanism 44 (proximal span), which mechanism is functionally positioned between the elongate member sidewalls 24L/R. It better depicts the operative components, including (actuating) spanner member 36 attached to transverse hollow member 54, the opposing linear channels 56L/R recessed in member sidewalls 24L/R, tracking rollers 48L/R, axle support bracket 60, and bolted tensioning band 58.

Figure 9:
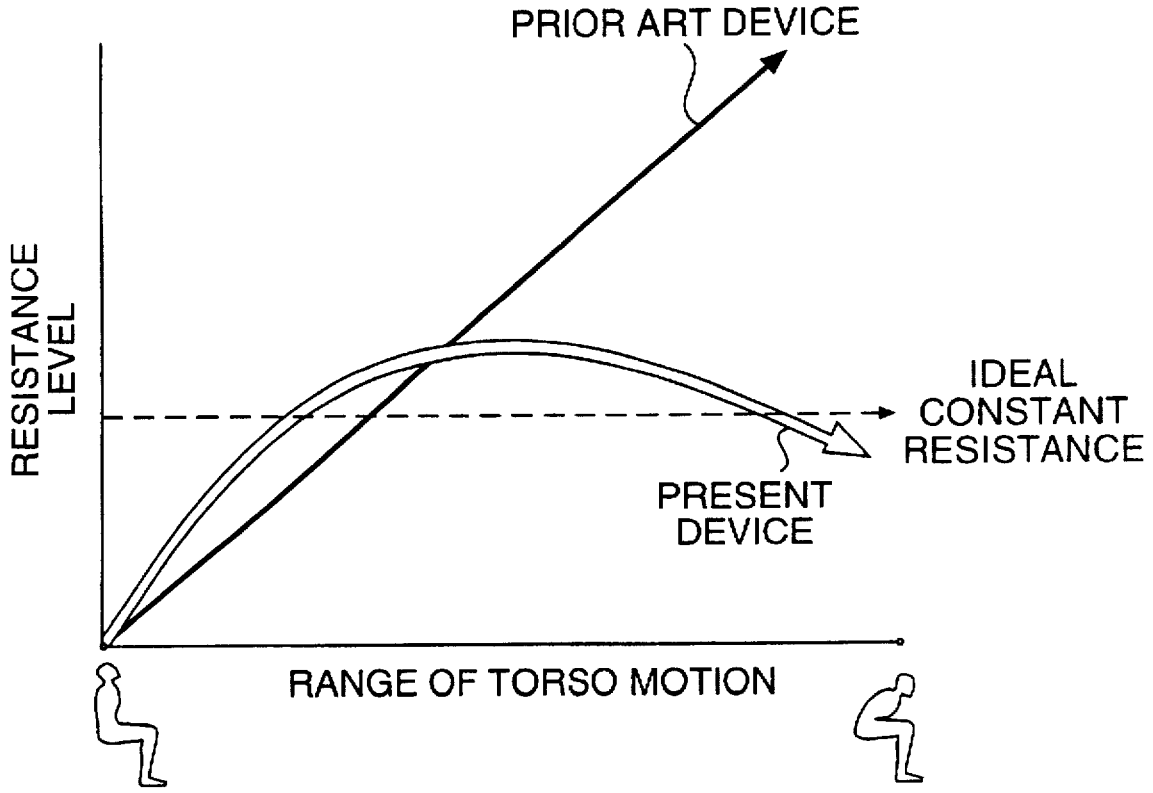
FIG. 9 is a comparative graph of the present exercise device having its variable resistance level plotted against its inherent range of motion and reflecting the difference between the varying resistance level of the present device as compared with the progressive resistance level of another device of the prior art patent to Miller '545.
Figure 10:
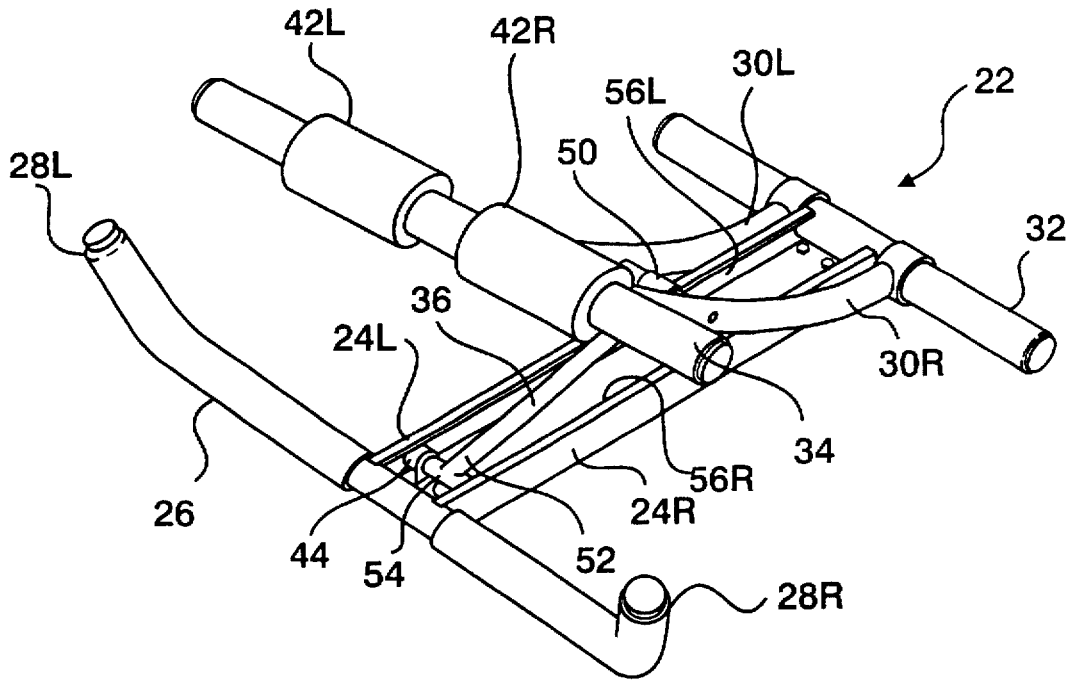
FIG. 10 shows the device of FIG. 5, converted from the operating mode, and folded up (tension band partly released), and made more portable for storage.

The conditioning advantage of the present invention over the abdominal-limited exercise device of Miller ('425) is shown in FIG. 9. The ideal constant resistance level is plotted diagrammatically, as resistance level vs. range of torso motion for the crunching exercise of FIG. 1. The linearly increasing resistance level of the prior art device is also plotted. The variable resistance level of the present device, as plotted, shows it to approach, and follow broadly, a constant and desired resistance level. This operating feature fosters smoother and more uniform repetitions for the abdominal exercise, in particular, as compared to the prior art device.

I claim:

1. A multifunctional, portable lap-based exercise device comprising:

(a) a first pair of spaced-apart, elongate parallel rigid members defining a substantially uniform linear trough having a proximal to the user torso first longitudinal end and a distal second longitudinal end;

(b) an upstanding, second pair of rigid members being attached at their lower longitudinal ends to the proximal longitudinal ends of the first pair of members;

(c) a first linear cross member aligned transversely at the junction of the first and second pairs of members and adapted to afford lateral stability to the device while same is positioned in the lap of a user;

(d) a second cross member aligned transversely at the upper longitudinal ends of the second pair of members and adapted to be anchored centrally thereof, so to afford added lateral stability to the device while positioned in the lap;

(e) a short third cross member located straddling and interconnected with the spaced-apart members of the second pair intermediate of their longitudinal ends;

(f) a single rigid spanning bar connected pivotally at its upper longitudinal end to the third cross member and connected at its lower longitudinal end to a short fourth cross member, which fourth member straddles the linear, uniform trough located between the parallel members of the first pair;

(g) a linear channel disposed lengthwise of the inner surface of each of the opposing planar surfaces of the first pair and serving to provide a dual channel, linear track;

(h) a track-follower assembly operatively attached to the fourth cross member, which assembly traverses the linear channels of said first pair, with said fourth cross member being secured centrally thereof to the lower longitudinal end of such spanning bar;

(i) a horizontally-aligned, resilient tensioning band positioned within the trough and operatively attached at its distal end longitudinal to the fourth cross member and also secured at its proximal longitudinal end centrally of the first cross-member; and, (j) an elongate, fifth cross member secured across the distal longitudinal ends of said first pair and providing manually grippable means serving to activate the exercise device;

whereby upon drawing inwardly the fifth cross member in an arcuate range of motion, the spanning bar thereby moves the follower assembly distally along the linear track against the countervailing tension imposed thereon by the operatively-connected tensioning band, and conversely permitting the follower assembly to return to its at rest position as defined by the undistended length of the tensioning band.

2. The device according to claim 1 wherein said second pair of members are provided with an arcuate bow along their intermediate length.

3. The device according to claim 1 wherein the track-follower assembly is provided with laterally aligned roller means at the lower end of the spanning bar, which roller means traverse the linear channels of said first pair.

4. The device according to claim 1 wherein the second cross member is provided with sleeve-like cushion elements.

5. The device according to claim 1, wherein the fifth cross member is provided with upwardly oriented longitudinal ends for manually gripping.

* * * * *